US008893337B2

(12) United States Patent
Lynn

(10) Patent No.: US 8,893,337 B2
(45) Date of Patent: Nov. 25, 2014

(54) FIRE RESISTANT FLANGE FOR REMOVABLE TOP PANELS FOR USE IN MATTRESS ASSEMBLIES

(75) Inventor: Jeremy B. Lynn, Newnan, GA (US)

(73) Assignee: Dreamwell, Ltd., Las Vegas, NV (US)

( * ) Notice: Subject to any disclaimer, the term of this patent is extended or adjusted under 35 U.S.C. 154(b) by 176 days.

(21) Appl. No.: 13/207,569

(22) Filed: Aug. 11, 2011

(65) Prior Publication Data

US 2012/0036644 A1 Feb. 16, 2012

Related U.S. Application Data

(60) Provisional application No. 61/373,603, filed on Aug. 13, 2010.

(51) Int. Cl.

| | |
|---|---|
| ***A47C 17/86*** | (2006.01) |
| ***A47C 31/00*** | (2006.01) |
| ***A47C 27/00*** | (2006.01) |

(52) U.S. Cl.

CPC ..... *A47C 31/001* (2013.01); *A47C 27/00* (2013.01); *Y10S 5/954* (2013.01)

USPC ..... 5/698; 5/483; 5/737; 5/954; 5/500

(58) Field of Classification Search

USPC ..... 5/482, 483, 691, 692, 698, 700, 723, 5/737, 954, 498–500, 738

See application file for complete search history.

(56) References Cited

U.S. PATENT DOCUMENTS

| | | | | |
|---|---|---|---|---|
| 2,801,427 | A * | 8/1957 | Crocker | 5/483 |
| 4,424,600 | A | 1/1984 | Callaway | |
| 4,430,765 | A * | 2/1984 | Karpen | 5/698 |
| 4,449,261 | A * | 5/1984 | Magnusson | 5/722 |
| 4,504,990 | A * | 3/1985 | Scales et al. | 5/698 |
| 4,504,991 | A * | 3/1985 | Klancnik | 5/698 |
| 4,955,095 | A | 9/1990 | Gerrick | |
| 6,263,532 | B1 | 7/2001 | Miller | |
| 6,718,583 | B1 * | 4/2004 | Diaz | 5/698 |
| 7,150,059 | B2 * | 12/2006 | Small et al. | 5/698 |
| 7,225,487 | B2 * | 6/2007 | Small et al. | 5/698 |
| 7,370,380 | B2 | 5/2008 | DeFranks et al. | |
| 7,421,750 | B2 * | 9/2008 | Knoff | 5/698 |
| 7,827,637 | B2 * | 11/2010 | DeFranks | 5/699 |
| 8,074,313 | B2 * | 12/2011 | Marcangelo | 5/737 |
| 8,181,293 | B2 * | 5/2012 | DeFranks et al. | 5/691 |
| 8,458,837 | B2 * | 6/2013 | Marcangelo et al. | 5/737 |
| 2002/0144352 | A1 * | 10/2002 | Freeman et al. | 5/716 |
| 2005/0227558 | A1 * | 10/2005 | Small et al. | 442/136 |
| 2006/0048301 | A1 * | 3/2006 | Klancnik et al. | 5/698 |
| 2006/0236462 | A1 * | 10/2006 | Boyd | 5/698 |

(Continued)

FOREIGN PATENT DOCUMENTS

WO 2011072022 A1 6/2011

*Primary Examiner* — Nicholas Polito
*Assistant Examiner* — David R Hare
(74) *Attorney, Agent, or Firm* — Cantor Colburn LLP

(57) ABSTRACT

A removable top panel for a mattress assembly generally includes at least one layer having length and width dimensions sufficient to support a reclining body of the user; a mechanical fastener component disposed at about a perimeter edge of a bottom facing surface of the at least one layer, wherein the mechanical fastener is configured to provide releasable engagement to an underlying mattress body; and a layer of a fire resistant material extending inwardly from the perimeter edge. Also disclosed are mattress assemblies including the removable top panel.

18 Claims, 2 Drawing Sheets

(56) References Cited

U.S. PATENT DOCUMENTS

| | | | | |
|---|---|---|---|---|
| 2007/0066168 | A1 | 3/2007 | Small, Jr. et al. | |
| 2007/0067916 | A1 | 3/2007 | Poston | |
| 2007/0283493 | A1* | 12/2007 | Link et al. | 5/483 |
| 2008/0263774 | A1* | 10/2008 | Lee | 5/691 |
| 2009/0070940 | A1* | 3/2009 | Knoff | 5/698 |

* cited by examiner

FIRE RESISTANT FLANGE FOR REMOVABLE TOP PANELS FOR USE IN MATTRESS ASSEMBLIES

CROSS REFERENCE TO RELATED APPLICATIONS

The present application claims the benefit of U.S. Provisional Patent Application No. 61/373,603 filed on Aug. 13, 2010, the disclosure of which is incorporated by reference in its entirety.

BACKGROUND

The present disclosure generally relates to fire resistant mattress assemblies including a removable top panel and methods for manufacturing the fire resistant mattress assemblies.

Mattresses are often manufactured by covering an assembly of coil springs with a combination of a polyurethane form and/or matting, which is then enclosed in a cover ticking or other material. This combination provides a light, durable, and comfortable mattress at a reasonable cost.

Recently, fire prevention efforts have directed some attention to develop new mattress assemblies having a reduced likelihood to combust. To this end, mattress manufacturers have developed a number of different fire resistant mattress assemblies, each of which offers some benefits for reducing the likelihood that the mattress assembly will combust in the presence of a fire and/or heat. However, some mattress designs include removable top panels that are secured to an underlying mattress body by a mechanical fastener such as a plastic or metallic zipper. Despite fire resistant border materials, during a fire, the mechanical fastener can melt and allow the fire to penetrate the interior of the mattress, which may not be fire resistant.

Accordingly, there is a need in the art for fire resistant mattress assemblies that include a removable top panel.

BRIEF SUMMARY

Disclosed herein are mattress assemblies including removable panels, wherein the removable panel generally includes a layer of fire resistant material disposed about a periphery and on a bottom facing surface of the removable panel. In one embodiment, the removable panel for use with a mattress comprises at least one layer having length and width dimensions sufficient to support a reclining body of the user; a mechanical fastener component disposed at about a perimeter edge of a bottom facing surface of the at least one layer, wherein the mechanical fastener is configured to provide releasable engagement to an underlying mattress body; and a layer of a fire resistant material extending inwardly from the perimeter edge and on a bottom facing surface.

A mattress assembly including a removable top panel and a mattress body, the mattress assembly comprises a top panel comprising at least one layer having length and width dimensions sufficient to support a reclining body of the user, a first mechanical fastener component disposed at about a perimeter edge of a bottom facing surface of the at least one layer; a layer of a fire resistant material extending inwardly from the perimeter edge and positioned interiorly relative to the first mechanical fastener component; and a mattress body comprising a compressible core, and a second mechanical fastener component attached to a perimeter edge of an upper surface and configured for engagement and disengagement with the first mechanical fastener component.

The disclosure may be understood more readily by reference to the following detailed description of the various features of the disclosure and the examples included therein.

BRIEF DESCRIPTION OF THE DRAWINGS

Referring now to the figures wherein the like elements are numbered alike.

DETAILED DESCRIPTION

Figure 1:
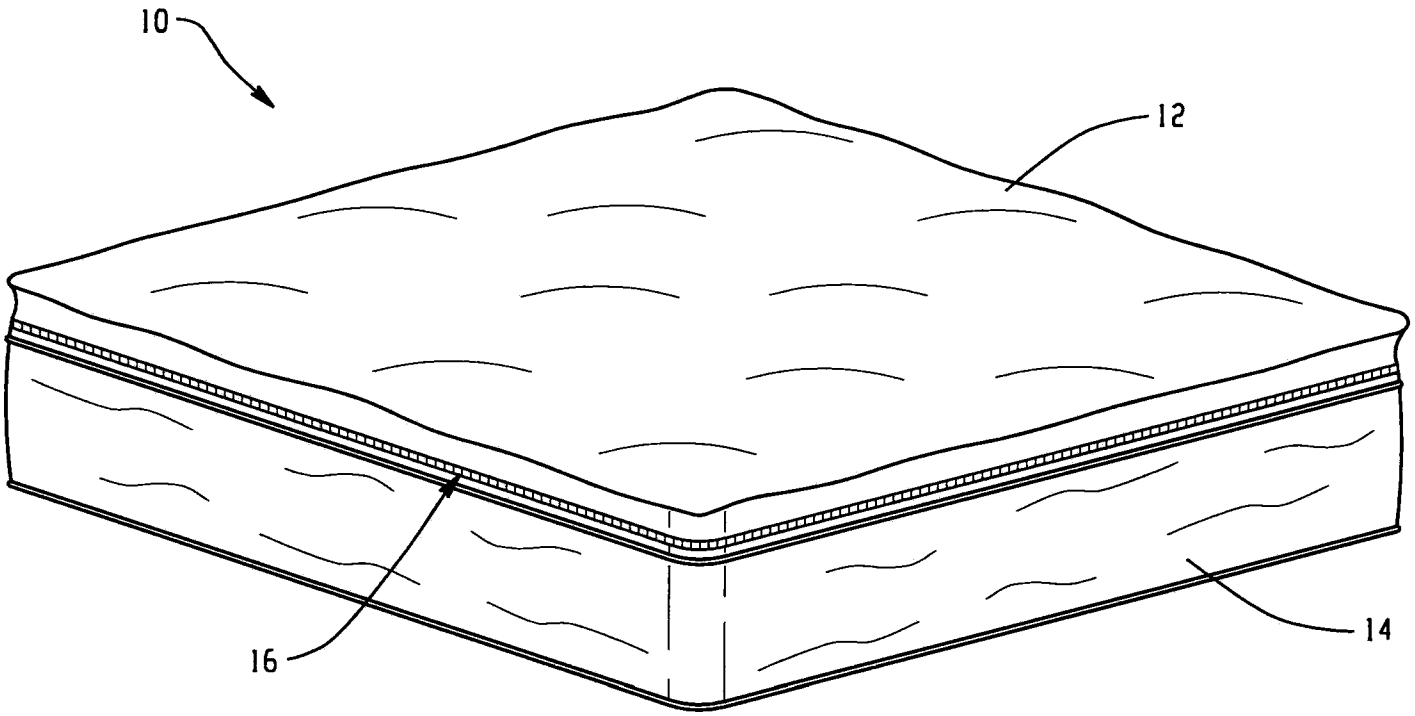
FIG. 1 illustrates is a front perspective view of a removable top panel attached to a mattress body.

The present disclosure is generally directed to mattress assemblies including a removable top panel, e.g., a pillow top, which is can bee engaged or disengaged from an underlying mattress body. Referring to FIG. 1, there is depicted a perspective view of an exemplary mattress assembly generally designated by reference numeral 10 that includes a removable top panel 12 attached to a mattress body 14. A mechanical fastener 16 is disposed about the perimeters of the top panel and the mattress body and is utilized to provide the removable attachment of the top panel to the mattress body. In this manner, the top panel can be replaced and/or cleaned while retaining use of the mattress body. As will be described in greater detail below, the top panel 12 further includes a fire resistant layer (not shown) that is positioned underneath the top panel about its perimeter, i.e., intermediate the top panel and the mattress body, to substantially prevent exposure of combustible heat and/or flame to the underside of the top panel in the event of mechanical fastener failure upon exposure to heat and/or flame. As used herein, the term "fire resistant material" generally means a material that does not melt, ignite, or decompose up to a temperature of 250° C. at ambient atmospheric oxygen levels.

Figure 2:
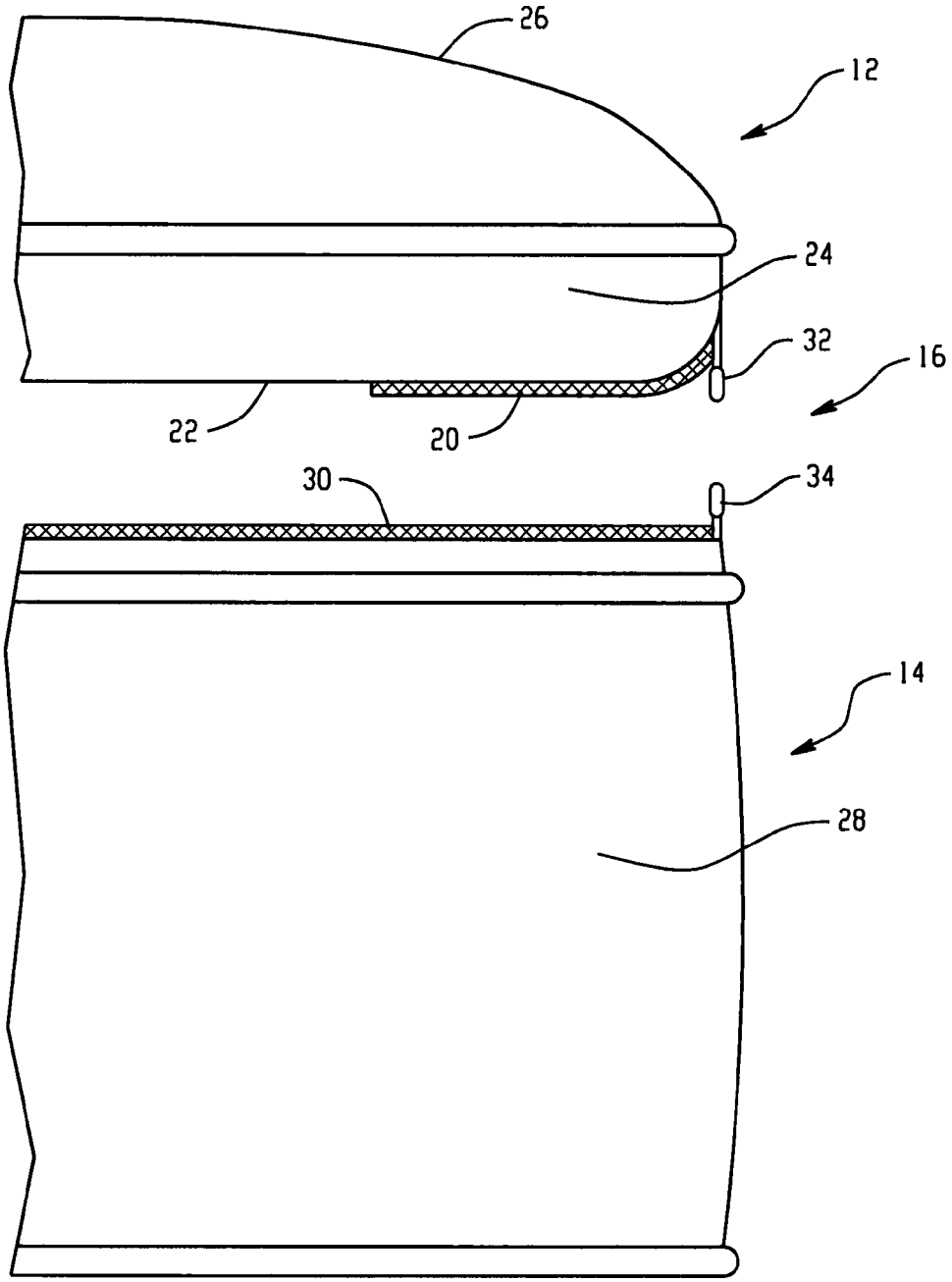
FIG. 2 illustrates a cross sectional view of the removable top panel.

As shown more clearly in FIG. 2, a layer 20 of fire resistant material is attached about a perimeter edge at the bottom facing portion 22 of the top panel 12 using, for example, an overcast stitch. The layer 20 is positioned interiorly behind the mechanical fastener, which is generally disposed on exterior surfaces of the top panel and mattress body for user convenience when attaching or removing the top panel. In some embodiments, the fire resistant material may be formed of one continuous layer that spans across the bottom facing portion 22 of the top panel 12. In other embodiments, the layer may be configured as a flange as shown that extends inwardly for a defined length from the perimeter edge along a bottom facing surface 22 of the top panel. In one embodiment, the fire resistant flange 20 extends inwardly about 12 inches to about 4 inches from the perimeter edge towards the center of the top panel; in other embodiments, the fire resistant flange extends inwardly from the perimeter edge about 10 inches to 6 inches; and in still other embodiments, the fire resistant flange extends inwardly from the perimeter for about 8 inches.

The top panel 12 itself generally includes a foam and/or fiber batting layer 24 and a quilt panel 26 attached to the foam layer 24. The quilt panel 26 is adapted to substantially face the user resting on the mattress assembly and has length and width dimensions sufficient to support a reclining body of the user. The foam and/or fiber batting acts like a pillow underneath the quilt panel and is typically formed of polyester, polyurethane, latex foam, and the like. The top panel may further include additional layers such as a moisture barrier layer, backing layers, breathable fabric layers, and the like.

The mattress body 14 is formed of resiliently compressible materials 28, such as for example, an inner spring core or a foam core of the type generally known in the art. For example, it may have a foam core, a spring core, a pocketed spring coil core, a viscoelastic core, or a core that combines foam and coils to provide a support structure for the sleeping user. The mattress body 14 further includes a fire resistant layer 30 spanning the uppermost surface of the mattress body. The composition of the fire resistant layer 30 may be the same as or have a different composition from the fire resistant layer and/or flange 20. The mattress body may further include other layers including, but not limited to a base foam layer underneath the core 26, a bottom panel, an upholstery foam layer on top of the core, and the like.

The mechanical fastener 16 includes attachment components 32, 34, wherein a selected one of the attachment components is secured at an upper surface and about the perimeter of the mattress body and the other one is secured to lower surface and about a perimeter of the top panel, respectively. The attachment components 32, 34 provide releasable engagement with one another to provide means for attachment and disengagement of the top panel from the mattress body. Suitable mechanical fasteners include, without limitation, zippers, hook and loop fasteners, button and buttonhole fasteners, and the like. The mechanical fasteners can be fabricated from metals, plastics, and/or the like, which can be fire resistant by themselves or coated with a fire resistant material. For ease of understanding, reference herein will be made to mechanical fastener that functions as a zipper.

The detailed constructions of mechanical fasteners, e.g., zippers, are generally known in the art and are described in various patents, such as U.S. Pat. No. 6,681,455 to Ichikawa which is incorporated herein by reference. The mechanical fastener may be constructed with metal plastic, and combinations thereof as is know in the art. In one embodiment, the mechanical fastener portion is formed a flame resistant material.

The fire resistant material for flange or layer 20 or layer 30 is configured not to ignite or propagate flame, and not to shrink, crack, break open, or melt away from a heat source. The fire resistant material for layer or flange 20 or layer 30 may be formed from various flame and heat resistant materials including, but not limited to, woven fabrics, nonwoven fabrics, knitted fabrics, films, laminates, and flexible composites, and combinations thereof. While a nonwoven fabric is preferred for substrates according to some embodiments, woven fabrics, braided fabrics, knitted fabrics, tufted fabrics, flocked fabrics, worplex fabrics, papers and/or combinations thereof could be used.

Exemplary nonwoven fabrics include needle punched fabric, spunbonded fabrics, thermal bonded fabrics, spunlaced fabrics, resin bonded fabrics, stitch bonded fabrics, and meltblown fabrics. Exemplary fabric fibers include, but are not limited to, thermoplastic and thermosetting fibers, and particularly temperature resistant fibers such as glass, asbestos, carbon, polyphenylene benzobisoxazole, polybenzimidazole, para-aramids, meta-aramids, fluorocarbons, polyphenylene sulfides, melamines, and polyimides. Synthetic fibers, such as polyester, may be blended to improve strength and/or dimensional stability of the flame-resistant substrate. Weight, blend ratio, and thickness of the material may be determined by the manufacturing process.

For nonwoven fabric, the product should be uniform and if a flame retardant or intumescent is required, it should be capable of holding the effective amount in its structure. The use of needlepunched, or spunlaced fabrics offer a wide variety of fiber choices and do not require thermoplastic fiber to form the substrate. Woven and knitted materials can offer many of the same advantages if the appropriate fiber blends are utilized.

Optionally, the fiber(s) can be formed into a batt or fabric web and then stitchbonded using the appropriate yarn to form the fire resistant layer or flange.

Flame and heat-resistant fibers utilized in the fire resistant layer and/or flange 20 include, but are not limited to, glass, aramid, polytetrafluoroethylene (PTFE), basalt, carbon, polyimide, phenolformaldehyde, polybis-imidazole, polyvinylidene chloride, ceramic, graphite, polysulfide, melamine, silicon carbide, and blends thereof.

Exemplary fibers that would be particularly useful to manufacture fabric substrates according to embodiments of the present invention include, but are not limited to, cellulose-based fibers such as viscose, silicic modified viscose, rayon, cotton, flax, lyocel, ramie, and wood pulp, KEVLAR®, a halogenated fabric, BASOFIL® fiber, a polyetherimide, flame resistant melamine resin, the silicic acid modified rayon marketed under the VISIL® brand, nonwoven fabrics commercially available from TIETEX under the product name C246, and TB303 commercially available from E. I. du Pont and Nemours and Company. Other non-thermoplastic fibers such as wool, polylactic acid, melamine, modacrylic, and acrylic, may be used.

According to other embodiments, the fire resistant material for flange or layer 20 or layer 30 is formed from materials that have been rendered flame resistant and high temperature resistant through the application of flame retardant chemicals. Flame retardant chemistry utilized in accordance with embodiments of the present invention includes, but is not limited to: borates such as boric acid, zinc borate or borax; sulfamates; phosphates such as ammonium polyphosphate; organic phosphorous compounds; halogenated compounds such as ammonium bromide, decabromodiphenyl oxide, or chlorinated paraffin; inorganic hydroxides such as aluminum or magnesium hydroxide, antimony compounds, and silica or silicates.

Boron compounds coat a fiber with a glassy film to insulate the polymer being protected. These compounds may increase the combustion temperature of the fuels and/or interfere with their flame chemistry.

Phosphorous compounds react with fibrous materials to prevent the formation of volatiles, which act as fuel to a flame. In addition, these compounds may promote the formation of char.

Nitrogen compounds alone are generally not good flame retardants. However, they may synergistically enhance the effects of phosphorous compounds to provide flame retarding effects.

Halogen compounds scavenge hydrogen and hydroxyl free radicals, thus breaking down the combustion chain reaction caused by these radicals.

In some embodiments, an intumescent coating can be applied to a substrate to form the fire resistant flange or layer 20. The intumescent coating may be applied to material as a lightweight and porous foam or froth using conventional coating techniques such as a knife coater, a roll coater, spray coating, calendaring, transfer coating or screen printing. Various intumescent compounds are known and one particular suitable class of intumescent compounds comprises a source of carbon (i.e., a carbonific compound), a catalyst, and a source of non-flammable gas (i.e., a roaming or blowing agent). Exemplary carbonific compounds include carbohydrates, proteins or polyfunctional alcohols such as starch, casein or pentaerythritol. On exposure to flame, the catalyst causes the carbonific compound to swell and char. Exemplary catalysts include inorganic acids such as boric, phosphoric, or sulfuric acid, or may include compounds which on decomposition form an inorganic acid such as mono- or diammonium phosphates, melamine, and urea.

When material having an intumescent coating exposed to high temperature and/or a flame, the intumescent coating reacts and swells to form a char. The char is substantially incombustible and has cellular characteristics. The char thus acts as a flame barrier and limits the penetration of flames and hot gases through the flange substrate to ignite the underlying flammable material within the top panel.

During manufacturing, the top panel 12 is cut to a desired size for the intended application, full size, queen size, king size and the like. The fire resistant layer or flange 20 is attached at about a perimeter edge of the top panel using, for example, an overcast stitch. The top panel may include one or more layers including, without limitation, a quilt panel 26 and a foam layer 24 as shown. By way of example, the fire resistant material can be attached using an automated panel and flange apparatus such as that described in U.S. Pat. No. 7,984,681 to Atlanta Attachment Company, incorporated herein by reference in its entirety. The system for automatically attaching the fire resistant flange or layer 20 to the perimeter edges of the panel generally includes a work table on which the panel is supported and a sewing assembly having a sewing machine located along a path of travel of the panel across the work table. For example, a flange of the fire resistant material can be fed from a supply of fire resistant flange material located adjacent the sewing assembly, and can be attached to the side edges and about the corners of the panel by the sewing machine of the sewing assembly. A clamp mechanism engages and holds the panel as the sewing machine of the sewing assembly attaches the fire resistant flange material about the corners of the panel. The perimeter edge of the top panel may then be inserted into the sewing machine with the fire resistant flange material tucked under the panel and aliened with one half of the mechanical fastener, e.g. zipper, which may be lock stitched to the bottom side of the panel such that the panel, fire resistant flange material, zipper and closing tape are lock stitched together to the perimeter edge of the panel.

With one half of the zipper attached to the top panel, the top panel may then be attached to the mattress body. As the top panel is zippered onto the mattress body, the fire resistant flange material is be tucked under the top panel such that the flange material is flat against the bottom facing portion of the top panel and inwardly extends from the perimeter edge.

Not to be bound by theory, but it is understood that during a fire, the mechanical fastener such as the zipper mechanism described above may melt and create openings between the mattress body and the top panel. These openings may permit fire and combustible heat to penetrate the interior of the mattress, including the foam padding provided in the top panel. The depicted fire resistant material acts as a bulwark that functions as a shield between the zipper and the interior foam padding.

The following examples are presented for illustrative purposes only, and are not intended to limit the scope of the invention.

In these examples, heat release was monitored for a mattress assembly in accordance with the present disclosure having a 7 or 8 inch fire resistant flange intermediate the removable top panel and mattress body and a comparative mattress assembly of similar construction without the fire resistant flange. Heat release was measured in accordance with Underwriting Laboratories 16 CFR 1633 Standards for the Flammability of Mattress Sets and are shown in Tables 1, 2 and 3 below. In Table 1, the fire resistant flange was non-woven fabric commercially available under the trade name C246 from Tietex International Co; in Table 2, the fire resistant flange was non-woven fabric commercially available under the trade name TB303 commercially available from E. I. du Pont and Nemours and Company; and in Table 3, no fire resistant flange was employed. Six samples were tested and averaged in Tables 1 and 2 whereas three samples were tested and averaged in Table 3.

TABLE 1

| 8" Fire Resistant Flange (C246) | |
|---|---|
| | Average |
| Peak Heat Release rate (kilowatts, kW) | 41 |
| Time of Peak Heat Release (minutes) | 0.5 |
| Total Heat Release in first 10 minutes (millijoules, mJ) | 4.1 |
| Total Heat Release for entire test (mJ) | 7.7 |

TABLE 2

| 7" Fire Resistant Flange (TB303) | |
|---|---|
| | Average |
| Peak Heat Release rate (kW) | 41 |
| Time of Peak Heat Release (minutes) | 0.5 |
| Total Heat Release in first 10 minutes (mJ) | 4.4 |
| Total Heat Release for entire test (mJ) | 9.5 |

TABLE 3

| Comparative-No Fire Resistant Flange | |
|---|---|
| | Average |
| Peak Heat Release rate (kW) | 202 |
| Time of Peak Heat Release (minutes) | 28.7 |
| Total Heat Release in first 10 minutes (mJ) | 9.0 |
| Total Heat Release for entire test (mJ) | 111.5 |

The data clearly shows a marked improvement in fire resistance for the mattress assemblies constructed with the fire resistant flange compared to mattress assemblies without the fire resistant flange. The mattress assemblies including the fire resistant flange exhibited an average peak heat release of 41 kW in contrast to 202 kW for mattress assemblies without the fire resistant flange. The average time of peak heat release was 0.5 minutes for mattress assemblies with the fire resistant flange compared to 28.7 minutes for mattress assemblies without the fire resistant flange. Total heat release in the first 10 minutes in the first 10 minutes for mattress assemblies without the fire resistant flange was 4.1 mJ and 4.4 mJ for the C246 Tietex flange, and TB303 DuPont flange whereas for mattress assemblies without the fire resistant flange the total heat release in 10 minutes more than doubled to 9.0 mJ. As for total heat release, the mattress assemblies with the fire resistant flange exhibited less than 10 mJ whereas the mattress assemblies without the fire resistant flange exhibited a tenfold increase to about 111 mJ.

Though the top panel is generally described with regards to adult mattresses of any size, the present invention may be used with any type of bed upon which there is a mattress-like element and a removable top panel. For example, the removable top panel may be used with a futon, crib, hospital bed, geriatric care bed, or waterbed. In addition, while a generally rectangular mattress has been described the mattress and the mattress cover can be of any variety of shapes.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A removable panel for use with a mattress, comprising at least one layer having length and width dimensions sufficient to support a reclining body of the user;

a mechanical fastener component disposed at about a perimeter edge of a bottom facing surface of the at least one layer, wherein the mechanical fastener is configured to provide releasable engagement to an underlying mattress body; and a layer of a fire resistant material having one end attached about the perimeter edge and a free end extending inwardly from the perimeter edge and on the bottom facing surface and when in use positioned to be intermediate the underlying mattress body and the bottom facing surface such that the layer of fire resistant material is not visible when the mechanical fastener is fastened to the underlying mattress body.

2. The removable panel of claim 1, wherein the layer of the fire resistant material is a flange inwardly extending for a defined distance from the perimeter edge.

3. The removable panel of claim 2, wherein flange inwardly extends from the perimeter edge for about 4 inches to about 12 inches.

4. The removable panel of claim 2, wherein flange inwardly extends from the perimeter edge for about 6 inches to about 10 inches.

5. The removable panel of claim 2, wherein flange inwardly extends from the perimeter edge for about 8 inches.

6. The removable panel of claim 1, wherein the mechanical fastener component comprises a zipper portion having engageable teeth, a hook, a loop, an adhesive strip, a button, a hole to receive a button, or a snap-fastener portion.

7. The removable panel of claim 1, wherein the layer of the fire resistant material is selected from the group consisting of nonwoven fabrics, woven fabrics, knitted fabrics, films, laminates, and flexible composites, and combinations thereof.

8. The removable panel of claim 1, wherein the layer of the fire resistant material comprises an intumescent material.

9. A mattress assembly including a removable top panel and a mattress body, the mattress assembly comprising:

a top panel comprising at least one layer having length and width dimensions sufficient to support a reclining body of the user, a first mechanical fastener component disposed at about a perimeter edge of a bottom facing surface of the at least one layer; a layer of a fire resistant material having one end attached about the perimeter edge and a free end extending inwardly from the perimeter edge and positioned interiorly relative to the first mechanical fastener component; and a mattress body comprising a compressible core, and a second mechanical fastener component attached to a perimeter edge of an upper surface and configured for engagement and disengagement with the first mechanical fastener component, wherein the layer of fire resistant material is not visible when the first mechanical fastener is in engagement with the first mechanical fastener component.

10. The mattress assembly of claim 9, wherein the layer of the fire resistant material is a flange inwardly extending for a defined distance from the perimeter edge.

11. The mattress assembly of claim 10, wherein the flange inwardly extends from the perimeter edge for about 4 inches to about 12 inches.

12. The mattress assembly of claim 10, wherein the flange inwardly extends from the perimeter edge for about 6 inches to about 10 inches.

13. The mattress assembly of claim 10, wherein the flange inwardly extends from the perimeter edge for about 8 inches.

14. The mattress assembly of claim 10, wherein the first and second mechanical fastener components define a zipper mechanism, a hook and loop fastener mechanism, an adhesive strip mechanism, a button and hole fastener mechanism, or a snap-fastener mechanism.

15. The mattress assembly of claim 9, wherein the layer of the fire resistant material is selected from the group consisting ofnonwoven fabrics, woven fabrics, knitted fabrics, films, laminates, and flexible composites, and combinations thereof.

16. The mattress assembly of claim 9, wherein the mattress assembly is one sided.

17. The mattress assembly of claim 9, wherein the upper surface of the mattress body comprises a fire resistant layer.

18. The mattress assembly of claim 17, wherein the fire resistant layer of the mattress body is different from the layer of the fire resistant material of the top panel.

* * * * *